US007976295B2

(12) United States Patent
Stover et al.

(10) Patent No.: US 7,976,295 B2
(45) Date of Patent: Jul. 12, 2011

(54) COMPRESSOR HAVING CAPACITY MODULATION SYSTEM

(75) Inventors: Robert C. Stover, Versailles, OH (US); Masao Akei, Miamisburg, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 218 days.

(21) Appl. No.: 12/474,633

(22) Filed: May 29, 2009

(65) Prior Publication Data

US 2009/0297377 A1 Dec. 3, 2009

Related U.S. Application Data

(60) Provisional application No. 61/057,448, filed on May 30, 2008.

(51) Int. Cl.
*F04C 18/00* (2006.01)
*F04C 2/00* (2006.01)

(52) U.S. Cl. ..... 418/55.5; 418/15; 418/55.1; 418/57; 418/180; 417/310; 417/308; 417/299

(58) Field of Classification Search ..... 418/15, 418/55.1–55.6, 57, 180, 270; 417/299, 307, 417/308, 310, 440
See application file for complete search history.

(56) References Cited

U.S. PATENT DOCUMENTS

| | | | | |
|---|---|---|---|---|
| 4,382,370 | A | 5/1983 | Suefuji et al. | |
| 4,383,805 | A | 5/1983 | Teegarden et al. | |
| 4,497,615 | A | 2/1985 | Griffith | |
| 4,669,962 | A * | 6/1987 | Mizuno et al. | 418/55.5 |
| 4,774,816 | A | 10/1988 | Uchikawa et al. | |
| 4,818,195 | A | 4/1989 | Murayama et al. | |
| 4,940,395 | A | 7/1990 | Yamamoto et al. | |
| 5,074,760 | A | 12/1991 | Hirooka et al. | |
| RE34,148 | E | 12/1992 | Terauchi et al. | |
| 5,169,294 | A | 12/1992 | Barito | |
| 5,192,195 | A | 3/1993 | Iio et al. | |
| 5,193,987 | A | 3/1993 | Iio et al. | |
| 5,240,389 | A | 8/1993 | Oikawa et al. | |
| 5,356,271 | A | 10/1994 | Miura et al. | |
| 5,451,146 | A | 9/1995 | Inagaki et al. | |
| 5,551,846 | A | 9/1996 | Taylor et al. | |

(Continued)

FOREIGN PATENT DOCUMENTS

JP 03081588 A 4/1991

(Continued)

OTHER PUBLICATIONS

International Search Report dated Jan. 21, 2010 regarding International Application No. PCT/US2009/045638.

(Continued)

*Primary Examiner* — Theresa Trieu
(74) *Attorney, Agent, or Firm* — Harness, Dickey & Pierce, P.L.C.

(57) ABSTRACT

A compressor includes a housing, a first scroll member supported within the housing and having a first end plate with a discharge passage, and a second scroll member supported within the housing and having a second end plate with a second spiral wrap extending therefrom and meshingly engaged with the first spiral wrap to form a series of pockets. A first aperture extends through the first end plate and is in communication with a first product of the series of pockets. A modulation assembly axially biases the first scroll member into engagement with the second scroll member when the first aperture is in communication with a suction pressure region of the compressor.

20 Claims, 4 Drawing Sheets

U.S. PATENT DOCUMENTS

| | | | | |
|---|---|---|---|---|
| 5,557,897 | A | 9/1996 | Kranz et al. | |
| 5,562,426 | A | 10/1996 | Watanabe et al. | |
| 5,577,897 | A | 11/1996 | Inagaki et al. | |
| 5,639,225 | A | 6/1997 | Matsuda et al. | |
| 5,674,058 | A | 10/1997 | Matsuda et al. | |
| 5,678,985 | A | 10/1997 | Brooke et al. | |
| 5,855,475 | A | 1/1999 | Fujio et al. | |
| 5,885,063 | A | 3/1999 | Makino et al. | |
| 5,993,171 | A | 11/1999 | Higashiyama | |
| 5,993,177 | A | 11/1999 | Terauchi et al. | |
| 6,102,671 | A | 8/2000 | Yamamoto et al. | |
| 6,123,517 | A | 9/2000 | Brooke et al. | |
| 6,132,179 | A | 10/2000 | Higashiyama | |
| 6,164,940 | A | 12/2000 | Terauchi et al. | |
| 6,176,686 | B1 * | 1/2001 | Wallis et al. | 417/310 |
| 6,210,120 | B1 | 4/2001 | Hugenroth et al. | |
| 6,231,316 | B1 | 5/2001 | Wakisaka et al. | |
| 6,273,691 | B1 | 8/2001 | Morimoto et al. | |
| 6,293,767 | B1 * | 9/2001 | Bass | 417/310 |
| 6,350,111 | B1 | 2/2002 | Perevozchikov et al. | |
| 6,412,293 | B1 | 7/2002 | Pham et al. | |
| 6,413,058 | B1 | 7/2002 | Williams et al. | |
| 6,589,035 | B1 | 7/2003 | Tsubono et al. | |
| 6,769,888 | B2 | 8/2004 | Tsubono et al. | |
| 6,884,042 | B2 | 4/2005 | Zili et al. | |
| 6,984,114 | B2 | 1/2006 | Zili et al. | |
| 7,118,358 | B2 | 10/2006 | Tsubono et al. | |
| 7,137,796 | B2 | 11/2006 | Tsubono et al. | |
| 7,229,261 | B2 | 6/2007 | Morimoto et al. | |
| 7,344,365 | B2 | 3/2008 | Takeuchi et al. | |
| 7,354,259 | B2 | 4/2008 | Tsubono et al. | |
| 7,547,202 | B2 * | 6/2009 | Knapke | 418/55.5 |
| 2004/0146419 | A1 | 7/2004 | Kawaguchi et al. | |
| 2004/0197204 | A1 | 10/2004 | Yamanouchi et al. | |
| 2005/0019177 | A1 | 1/2005 | Shin et al. | |
| 2005/0053507 | A1 | 3/2005 | Takeuchi et al. | |
| 2008/0159892 | A1 | 7/2008 | Huang et al. | |
| 2009/0068048 | A1 * | 3/2009 | Stover et al. | 418/55.4 |
| 2009/0071183 | A1 * | 3/2009 | Stover et al. | 418/55.1 |
| 2009/0297378 | A1 * | 12/2009 | Stover et al. | 418/55.1 |
| 2009/0297379 | A1 * | 12/2009 | Stover et al. | 418/55.1 |
| 2009/0297380 | A1 * | 12/2009 | Stover et al. | 418/55.2 |
| 2010/0135836 | A1 * | 6/2010 | Stover et al. | 418/55.2 |
| 2010/0158731 | A1 * | 6/2010 | Akei et al. | 418/55.2 |
| 2010/0254841 | A1 * | 10/2010 | Akei et al. | 418/24 |
| 2010/0300659 | A1 * | 12/2010 | Stover et al. | 418/55.1 |
| 2010/0303659 | A1 * | 12/2010 | Stover et al. | 418/24 |

FOREIGN PATENT DOCUMENTS

| | | | |
|---|---|---|---|
| JP | 2000161263 | A | 6/2000 |
| JP | 2007154761 | A | 6/2007 |

OTHER PUBLICATIONS

Written Opinion of the International Searching Authority dated Jan. 21, 2010 regarding International Application No. PCT/US2009/045638.

U.S. Appl. No. 12/789,105, filed May 27, 2010, Stover et al.

U.S. Appl. No. 12/788,786, filed May 27, 2010, Stover et al.

U.S. Appl. No. 12/629,432, filed Dec. 2, 2009, Stover et al.

U.S. Appl. No. 12/474,736, filed May 29, 2009, Akei et al.

U.S. Appl. No. 12/474,806, filed May 29, 2009, Stover et al.

U.S. Appl. No. 12/474,868, filed May 29, 2009, Stover et al.

U.S. Appl. No. 12/474,954, filed May 29, 2009, Stover et al.

PCT/US2009/045630, May 29, 2009, Stover et al.

* cited by examiner

COMPRESSOR HAVING CAPACITY MODULATION SYSTEM

CROSS-REFERENCE TO RELATED APPLICATIONS

This application claims the benefit of U.S. Provisional Application No. 61/057,448, filed on May 30, 2008. The entire disclosure of the above application is incorporated herein by reference.

FIELD

The present disclosure relates to compressors, and more specifically to compressors having capacity modulation systems.

BACKGROUND

This section provides background information related to the present disclosure which is not necessarily prior art.

Scroll compressors include a variety of capacity modulation mechanisms to vary operating capacity of a compressor. The capacity modulation mechanisms may include fluid passages extending through a scroll member to selectively provide fluid communication between compression pockets and another pressure region of the compressor.

SUMMARY

This section provides a general summary of the disclosure, and is not a comprehensive disclosure of its full scope or all of its features.

A compressor may include a housing and a first scroll member supported within the housing and having a first end plate with a discharge passage. A first spiral wrap may extend from a first side of the first end plate. The first chamber may be located on the second side of the first end plate. A first passage may extend through the end plate and in communication with the first chamber and the discharge passage. A second passage may extend through the end plate from the first chamber to an outer surface of the first scroll member. A third passage may extend through the end plate from the first chamber to a suction pressure region of the compressor. A first aperture may extend through the first end plate and be in communication with the first chamber. A second scroll member may be supported within the housing and may include a second end plate having a second spiral wrap extending therefrom and meshingly engaged with the first spiral wrap to form a series of pockets. The first aperture may be in communication with the first of the pockets to provide communication between the first pocket and the first chamber. A piston is located within the first chamber and axially displaceable between first and second positions. The piston may isolate the first and second passages from communication with the first aperture and the third passage when in the first and second positions. The piston may prevent communication between the first aperture and the third passage when in the first position, and the piston may provide communication between the first aperture and the third passage when in the second position. A valve assembly may be in communication with the second passage to selectively vent the second passage to the suction pressure region of the compressor and displace the piston between the first and second positions.

The compressor may include a first passage in communication with the discharge passage when the piston is in the first and second positions.

The compressor may include a first passage that has a greater flow restriction than the second passage.

The compressor may include of a floating seal engaged with the first scroll member and defining a second chamber.

The compressor's piston may be located axially between the floating seal and the pockets.

The compressor discharge passage may be in communication with the suction pressure region when the second passage is vented to the suction pressure region.

The compressor's first chamber may include an annular chamber and the piston includes an annular piston.

The compressor may operate at full capacity when the piston in the first position.

The compressor may operate at approximately zero capacity when the piston is in the second position.

The compressor may include a first scroll member having a axial end surface that abuts the second scroll member when the piston is in the second position.

The compressor may include a biasing member engaged with the first scroll member to axially bias the first scroll member into engagement with the second scroll member when the piston is in the second position.

The compressor may operate at a full capacity when the piston is in the first position. The valve assembly may adapt to cycle the piston between the first and second positions to provide a compressor operating capacity between zero capacity and full capacity.

The compressor may include discharge a valve fixed to the housing to prevent reverse flow through the discharge passage. The first scroll member may be axially displaceable relative to the discharge valve.

A compressor may include a housing and a first scroll member supported within the housing and having a first end plate with a discharge passage. A first spiral wrap extends from a first side of the first end plate, and a first aperture extends through the first end plate. A second scroll member maybe supported within the housing and include a second end plate having a second spiral wrap extending therefrom and meshingly engaged with the first spiral wrap to form a series of pockets. A first aperture may be in communication with a first of the series of pockets. The modulation assembly maybe engaged with the first scroll member and selectively provide communication between the first aperture and a suction pressure region of the compressor. The biasing member maybe engaged with the first scroll member to axially bias the first scroll member into engagement with the second scroll member when the first aperture is in communication with the suction pressure region.

The compressor of the first scroll member may include a first chamber located on a second side of the first end plate and in communication with the first aperture and a first passage extending through the end plate and in communication with the first chamber and the suction pressure region. The modulation assembly may include a piston located within the first chamber and axially displaceable between first and second positions. The piston may isolate the first aperture from communication with the first passage when in the first position and provide communication between the first aperture and the first passage when in the second position.

The compressor of the first scroll member may include a second and third passage in communication with the first chamber. The second passage may extended through the end plate and in communication with the first chamber and the discharge passage and the third passage extending through the end plate from the first chamber to an outer surface of the first scroll member. The modulation assembly may include a valve assembly in communication with the third passage and selectively providing communication between the third passage and the suction pressure region to displace the piston between the first and second positions.

The compressor may include a discharge passage that is in communication with the suction pressure region when the piston is in the second position.

The compressor may include a floating seal engaged with the first scroll member and the housing to isolate the suction pressure region from the discharge passage. The floating seal and the housing may define a second chamber in communication with the second of the series of pockets to bias the first scroll member axially toward the second scroll member.

The compressor may include of a biasing member that is located within the second chamber and engaged with the floating seal and the first scroll member.

The compressor may include a biasing member that urges the floating seal into engagement with the housing to isolate the suction pressure region from the discharge passage when the first aperture is in communication with the suction pressure region.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
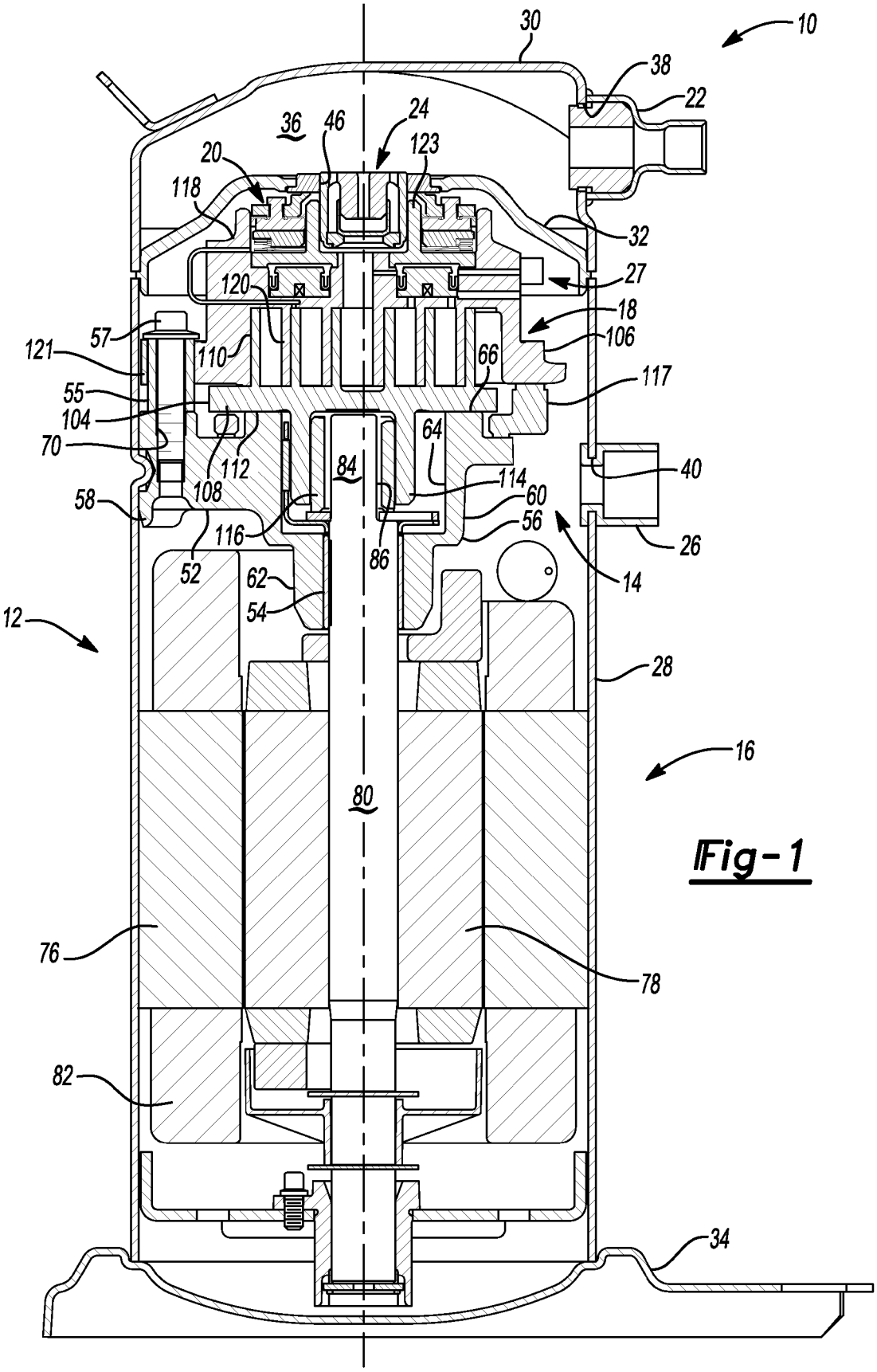
FIG. 1 is a section view of a compressor according to the present disclosure.

The following description is merely exemplary in nature and is not intended to limit the present disclosure, application, or uses. It should be understood that throughout the drawings, corresponding reference numerals indicate like or corresponding parts and features.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, compressor 10 may include a hermetic shell assembly 12, a main bearing housing assembly 14, a motor assembly 16, a compression mechanism 18, a seal assembly 20, a refrigerant discharge fitting 22, a discharge valve assembly 24, a suction gas inlet fitting 26, and a modulation assembly 27. Shell assembly 12 may form a compressor housing and may house main bearing housing assembly 14, motor assembly 16, and compression mechanism 18.

Shell assembly 12 may generally form a compressor housing and may include a cylindrical shell 28, an end cap 30 at the upper end thereof, a transversely extending partition 32, and a base 34 at a lower end thereof. End cap 30 and partition 32 may generally define a discharge chamber 36. Discharge chamber 36 may generally form a discharge muffler for compressor 10. Refrigerant discharge fitting 22 may be attached to shell assembly 12 at opening 38 in end cap 30. Suction gas inlet fitting 26 may be attached to shell assembly 12 at opening 40. Partition 32 may include a discharge passage 46 therethrough having discharge valve assembly 24 fixed thereto to provide communication between compression mechanism 18 and discharge chamber 36.

Main bearing housing assembly 14 may be affixed to shell 28 at a plurality of points in any desirable manner, such as staking. Main bearing housing assembly 14 may include a main bearing housing 52, a first bearing 54 disposed therein, bushings 55, and fasteners 57. Main bearing housing 52 may include a central body portion 56 having a series of arms 58 extending radially outwardly therefrom. Central body portion 56 may include first and second portions 60, 62 having an opening 64 extending therethrough. Second portion 62 may house first bearing 54 therein. First portion 60 may define an annular flat thrust bearing surface 66 on an axial end surface thereof. Arm 58 may include apertures 70 extending therethrough and receiving fasteners 57.

Motor assembly 16 may generally include a motor stator 76, a rotor 78, and a drive shaft 80. Windings 82 may pass through stator 76. Motor stator 76 may be press fit into shell 28. Drive shaft 80 may be rotatably driven by rotor 78. Rotor 78 may be press fit on drive shaft 80. Drive shaft 80 may include an eccentric crank pin 84 having a flat 86 thereon.

Compression mechanism 18 may generally include an orbiting scroll 104 and a non-orbiting scroll 106. Orbiting scroll 104 may include an end plate 108 having a spiral vane or wrap 110 on the upper surface thereof and an annular flat thrust surface 112 on the lower surface. Thrust surface 112 may interface with annular flat thrust bearing surface 66 on main bearing housing 52. A cylindrical hub 114 may project downwardly from thrust surface 112 and may have a drive bushing 116 rotatively disposed therein. Drive bushing 116 may include an inner bore in which crank pin 84 is drivingly disposed. Crank pin flat 86 may drivingly engage a flat surface in a portion of the inner bore of drive bushing 116 to provide a radially compliant driving arrangement. An Oldham coupling 117 may be engaged with the orbiting and non-orbiting scrolls 104, 106 to prevent relative rotation therebetween.

Figure 2:
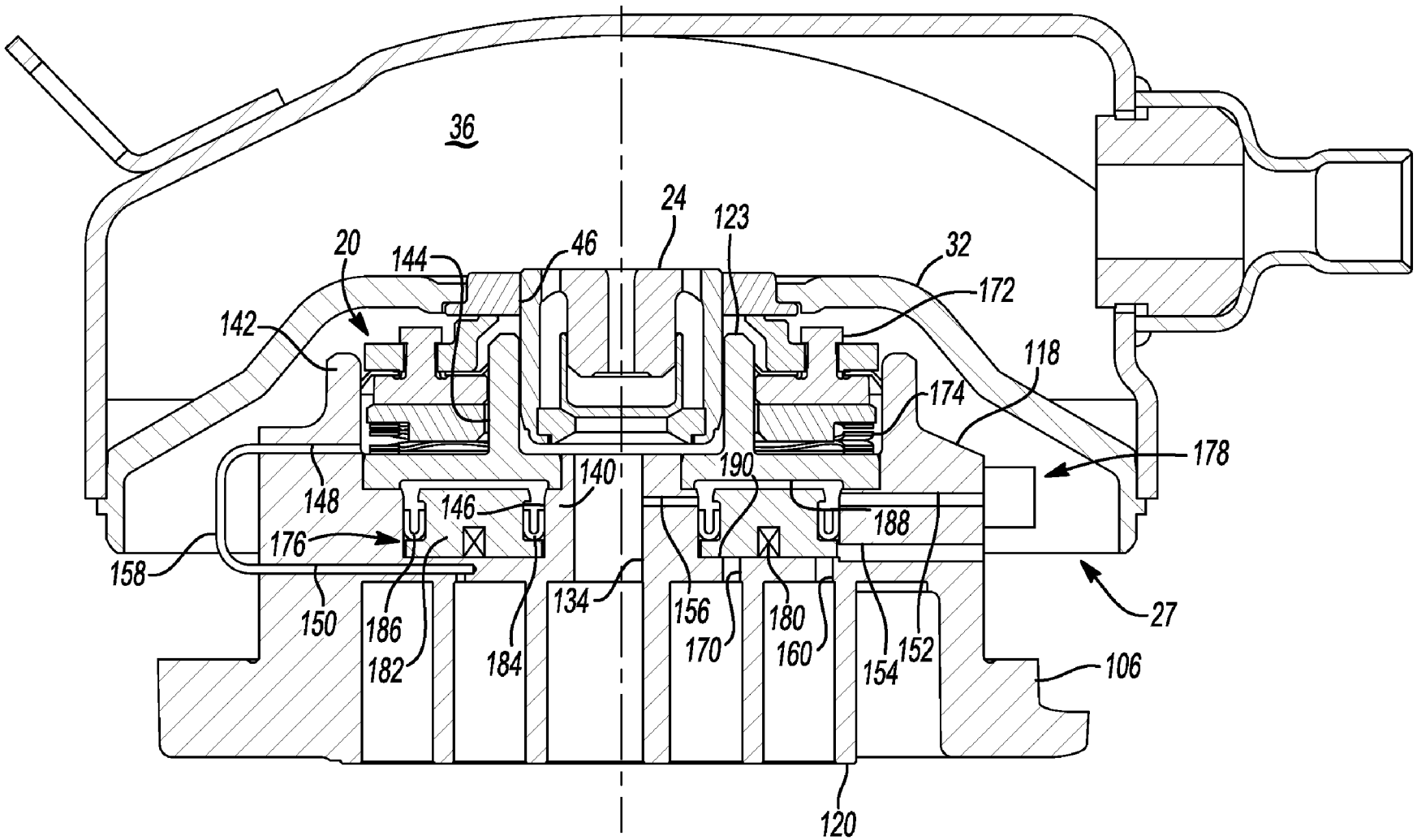
FIG. 2 is a section view of a non-orbiting scroll, seal assembly, and modulation system of the compressor of FIG. 1.
Figure 3:
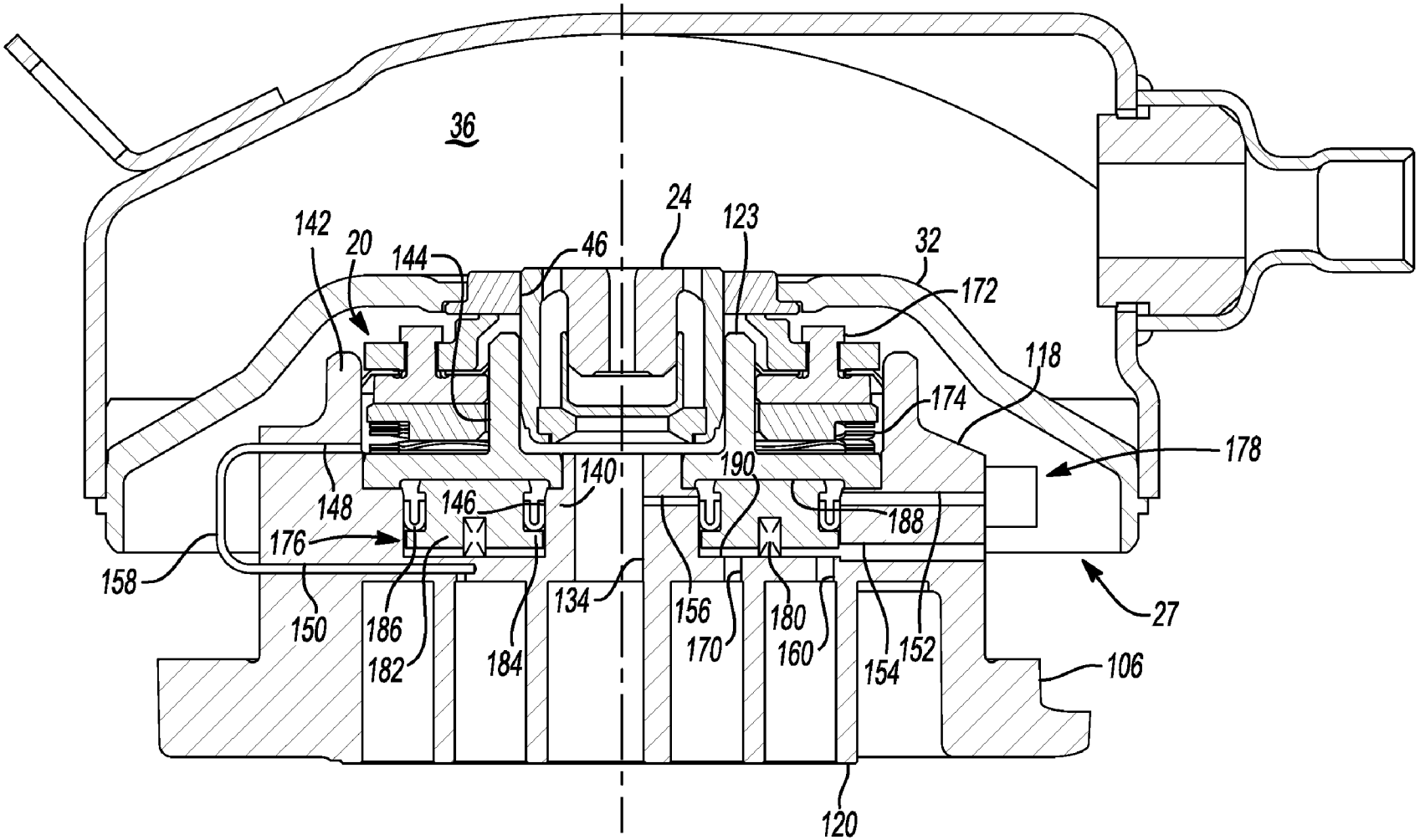
FIG. 3 is an additional section view of the non-orbiting scroll, seal assembly, and modulation system of FIG. 2.
Figure 4:
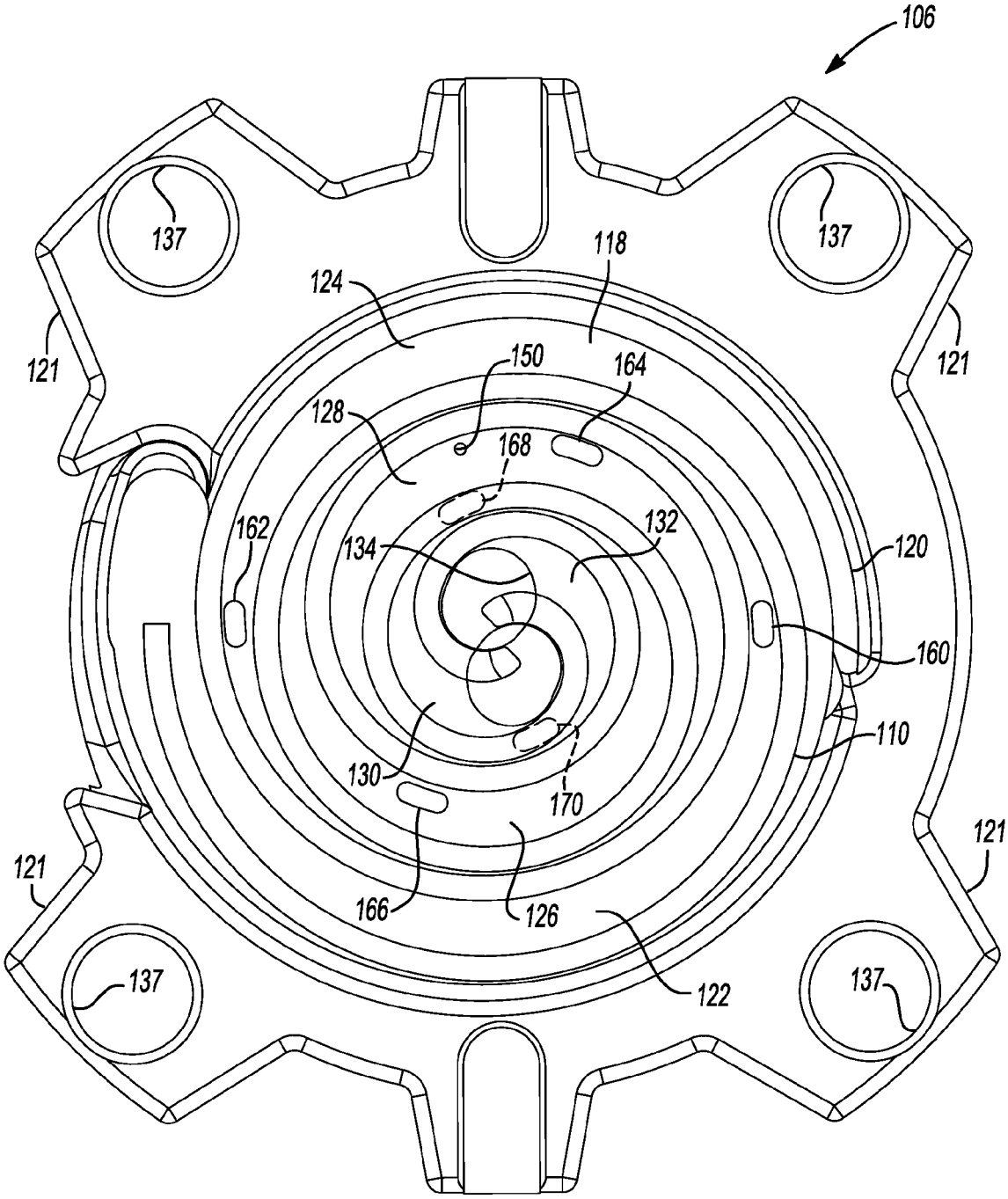
FIG. 4 is a plan view of a non-orbiting scroll of the compressor of FIG. 1.

With additional reference to FIGS. 2-4, non-orbiting scroll 106 may include an end plate 118 having a spiral wrap 120 on a lower surface thereof, a series of radially outwardly extending flanged portions 121, and an annular hub 123. Spiral wrap 120 may form a meshing engagement with wrap 110 of orbiting scroll 104, thereby creating a series of pockets 122, 124, 126, 128, 130, 132. Non-orbiting scroll 106 may be axially displaceable relative to main bearing housing assembly 14, shell assembly 12, and orbiting scroll 104. Non-orbiting scroll 106 may include a discharge passage 134 in communication with pocket 130, 132 and in fluid communication with discharge chamber 36 via discharge valve assembly 24.

Flanged portions 121 may include openings 137 therethrough. Openings 137 may receive bushings 55 therein and bushings 55 may receive fasteners 57. Fasteners 57 may be engaged with main bearing housing 52 and bushings 55 may generally form a guide for axial displacement of non-orbiting scroll 106. Fasteners 57 may additionally prevent rotation of non-orbiting scroll 106 relative to main bearing housing assembly 14.

End plate 118 may include parallel coaxial inner and outer side walls 140, 142. Annular hub 123 may be fixed to end plate 118 and may cooperate with end plate 118 and seal assembly 20 to form first and second annular chambers 144, 146. Discharge valve assembly 24 may be fixed within discharge passage 46 to prevent a reverse flow condition through compression mechanism 18. End plate 118 may include first, second, third, fourth and fifth passages 148, 150, 152, 154, 156. First passage 148 may extend radially outwardly from first annular chamber 144 to an outer radial surface of non-orbiting scroll 106. Second passage 150 may be in communication with pocket 128 and may extend radially outwardly to an outer radial surface of non-orbiting scroll 106. A conduit 158 may extend from first passage 148 to second passage 150 to provide communication between pocket 128 and first annular chamber 144. Third and fourth passages 152, 154 may each extend radially outwardly from second annular chamber 146 to an outer radial surface of non-orbiting scroll 106. Fifth passage 156 may extend radially inwardly from second annular chamber 146 to discharge passage 134 of non-orbiting scroll 106 and may have a greater restriction than third passage 152. For example, fifth passage 156 may have a smaller diameter than third passage 152.

First and second annular chambers 144, 146 may be isolated from one another. First annular chamber 144 may provide for axial biasing of non-orbiting scroll 106 relative to orbiting scroll 104 and second annular chamber 146 may cooperate with modulation assembly 27 to adjust capacity of compressor 10, as discussed below. Apertures 160, 162, 164, 166, 168, 170 may extend through end plate 118, placing second annular chamber 146 in communication with pockets 122, 124, 126, 128 during compressor operation, while allowing isolation of pockets 130,132 from second annular chamber 146.

Seal assembly 20 may include a floating seal 172 and a biasing member 174, such as a compression spring, located within first annular chamber 144. Floating seal 172 may be axially displaceable relative to non-orbiting scroll 106 to provide for axial displacement of non-orbiting scroll 106 while maintaining a sealed engagement with partition 32 to isolate discharge and suction pressure regions of compressor 10 from one another. More specifically, pressure within first annular chamber 144 may bias floating seal 172 into engagement with partition 32 during normal compressor operation. Biasing member 174 may provide an additional force urging floating seal 172 into engagement with partition 32.

Modulation assembly 27 may include a piston assembly 176, a valve assembly 178, and a biasing member 180. The piston assembly 176 may include an annular piston 182 and first and second annular seals 184, 186. Annular piston 182 may be located in second annular chamber 146 and first and second annular seals 184, 186 may be engaged with inner and outer side walls 140,142 to separate second annular chamber 146 into first and second portions 188, 190 that are isolated from one another. First portion 188 may be in communication with third and fifth passages 152, 156 and second portion 190 may be in communication with fourth passage 154. Valve assembly 178 may selectively vent third passage 152, and therefore first portion 188 to suction pressure. The smaller diameter of fifth passage 156 generally prevents pressure build-up in first portion 188 when valve assembly 178 vents first portion 188 to suction pressure. Biasing member 180 may include a spring and may be located in second portion 190 and engaged with annular piston 182.

Annular piston 182 may be displaceable between first and second positions. In the first position (FIG. 2), annular piston 182 may seal apertures 160, 162, 164, 166, 168, 170 from communication with second portion 190 of second annular chamber 146. The first position may generally correspond to a full capacity mode of compressor 10. In the second position (FIG. 3), annular piston 162 may be displaced from apertures 160, 162, 164, 166, 168, 170, providing communication between apertures 160, 162, 164, 166, 168, 170 and second portion 190 of second annular chamber 146. Therefore, when annular piston 182 is in the second position, apertures 160, 162, 164, 166, 168, 170 may be in communication with a suction pressure region of compressor 10 via fourth passage 154.

The second position may generally correspond to a reduced capacity mode of compressor 10. The reduced capacity mode may include compressor operation at a capacity of approximately zero. During the reduced capacity mode, each of pockets 122, 124, 126, 128 may be vented to the suction pressure region of compressor 10. A small amount of compression may remain from pockets 130, 132. However, the compression from pockets 130, 132 may be vented to the suction pressure region through valve assembly 178.

The reduced capacity mode may further include an intermediate capacity where compressor 10 operates at a capacity between zero and full capacity. The intermediate capacity may be achieved by cycling displacement of annular piston 182 between the first and second positions by cycling the valve assembly 178 between first and second positions. The duty cycle may be determined as the fraction of time that annular piston 182 is in the open position. Capacity modulation may be accomplished in any manner known in the art, including pulse-width modulation wherein the pulse width is modulated to vary the average value of the control signal waveform.

Discharge valve assembly 24 may prevent a reverse flow from discharge chamber 36 to compression mechanism 18 during reduced capacity operation of compressor 10. Fixing discharge valve assembly 24 to partition 32 may reduce the axial force applied to non-orbiting scroll 106, particularly during a low- or zero-capacity mode.

Fifth passage 156 may continuously be in communication with discharge pressure from discharge passage 134. When valve assembly 178 is in the closed position, pressure within first portion 188 of second annular chamber 146 may maintain annular piston 182 in the first position. When valve assembly 178 is in the open position, first portion 188 of second annular chamber 146 may be in communication with the suction pressure region of compressor 10. Fifth passage 156 may therefore also be in communication with suction pressure. Biasing member 180 may urge annular piston 182 to the second position providing communication between apertures 160, 162, 164, 166, 168, 170 and suction pressure. Annular piston 182 may be returned to the first position by closing valve assembly 178. The compression provided by pockets 130, 132 may provide a pressure to first portion 188 of second annular chamber 146 when valve assembly 178 is closed to return annular piston 182 to the first position.

When annular piston 182 is in the first position (FIG. 2), non-orbiting scroll 106 may be biased axially against and engaged with orbiting scroll 104 by the pressure within first annular chamber 144 from pocket 128 as well as by biasing member 174 acting on floating seal 172 and non-orbiting scroll 106. When annular piston 182 is in the second position (FIG. 3), non-orbiting scroll 106 may no longer be biased against orbiting scroll 104 by the pressure within first annular chamber 144 from pocket 128 since pocket 128 is in communication with suction pressure. However, biasing member 174 may continue to act on floating seal 172 and non-orbiting scroll 106 to axially bias non-orbiting scroll 106 against and into engagement with orbiting scroll 104 and to axially bias floating seal 172 into engagement with partition 32.

Therefore, non-orbiting scroll 106 may contact orbiting scroll 104 when annular piston 182 is in the first and second positions and floating seal 172 may remain in sealing engagement with partition 32 to isolate the suction pressure region from discharge passage 134. More specifically, an axial end surface of non-orbiting scroll 106 may contact orbiting scroll 104 and an axial end surface of orbiting scroll 104 may contact non-orbiting scroll 106 when annular piston 182 is in both the first and second positions. For example, wrap 110 of orbiting scroll 104 may contact end plate 118 of non-orbiting scroll 106 and wrap 120 of non-orbiting scroll 106 may contact end plate 108 of orbiting scroll 104. Thus, the orbiting and non-orbiting scrolls 104, 106 may axially contact one another when compressor 10 is operated at the full capacity mode as well as when compressor 10 is operated at approximately zero capacity, or at any reduced capacity between full and zero capacity.

The terms "first", "second", etc. are used throughout the description for clarity only and are not intended to limit similar terms in the claims.

What is claimed is:

1. A compressor comprising:

a housing;

a first scroll member supported within said housing and including a first end plate having a discharge passage, a first spiral wrap extending from a first side of said first end plate, a first chamber located on a second side of said first end plate, a first passage extending through said end plate and in communication with said first chamber and said discharge passage, a second passage extending through said end plate from said first chamber to an outer surface of said first scroll member, a third passage extending through said end plate from said first chamber to a suction pressure region of the compressor, and a first aperture extending through said first end plate and in communication with said first chamber;

a second scroll member supported within said housing and including a second end plate having a second spiral wrap extending therefrom and meshingly engaged with said first spiral wrap to form a series of pockets, said first aperture being in communication with a first of said pockets to provide communication between said first pocket and said first chamber;

a piston located within said first chamber and axially displaceable between first and second positions, said piston isolating said first and second passages from communication with said first aperture and said third passage when in the first and second positions, said piston preventing communication between said first aperture and said third passage when in the first position, and said piston providing communication between said first aperture and said third passage when in the second position; and a valve assembly in communication with said second passage to selectively vent said second passage to the suction pressure region of the compressor and displace said piston between the first and second positions.

2. The compressor of claim 1, wherein said first passage is in communication with said discharge passage when said piston is in the first and second positions.

3. The compressor of claim 1, wherein said first passage has a greater flow restriction than said second passage.

4. The compressor of claim 1, further comprising a floating seal engaged with said first scroll member and defining a second chamber.

5. The compressor of claim 4, wherein said piston is located axially between said floating seal and said pockets.

6. The compressor of claim 1, wherein said discharge passage is in communication with the suction pressure region when said second passage is vented to the suction pressure region.

7. The compressor of claim 1, wherein said first chamber includes an annular chamber and said piston includes an annular piston.

8. The compressor of claim 1, wherein the compressor operates at a full capacity when said piston in the first position.

9. The compressor of claim 1, wherein the compressor operates at approximately zero capacity when said piston is in the second position.

10. The compressor of claim 9, wherein an axial end surface of said first scroll member abuts said second scroll member when said piston is in the second position.

11. The compressor of claim 9, further comprising a biasing member engaged with said first scroll member and axially biasing said first scroll member into engagement with said second scroll member when said piston is in the second position.

12. The compressor of claim 9, wherein the compressor operates at a full capacity when said piston is in the first position, said valve assembly adapted to cycle said piston between the first and second positions to provide a compressor operating capacity between zero capacity and full capacity.

13. The compressor of claim 1, further comprising a discharge valve fixed to said housing to prevent reverse flow through said discharge passage, said first scroll member being axially displaceable relative to said discharge valve.

14. A compressor comprising:

a housing;

a first scroll member supported within said housing and including a first end plate having a discharge passage, a first spiral wrap extending from a first side of said first end plate, and a first aperture extending through said first end plate;

a second scroll member supported within said housing and including a second end plate having a second spiral wrap extending therefrom and meshingly engaged with said first spiral wrap to form a series of pockets, said first aperture being in communication with a first of said pockets;

a modulation assembly engaged with said first scroll member and selectively providing communication between said first aperture and a suction pressure region of the compressor; and a biasing member engaged with said first scroll member and axially biasing said first scroll member into engagement with said second scroll member when said first aperture is in communication with the suction pressure region.

15. The compressor of claim 14, wherein said first scroll member includes a first chamber located on a second side of said first end plate and in communication with said first aperture and a first passage extending through said end plate and in communication with said first chamber and the suction pressure region, said modulation assembly including a piston located within said first chamber and axially displaceable between first and second positions, said piston isolating said first aperture from communication with said first passage when in the first position and providing communication between said first aperture and said first passage when in the second position.

16. The compressor of claim 15, wherein said first scroll member includes second and third passages in communication with said first chamber, said second passage extending through said end plate and in communication with said first chamber and said discharge passage and said third passage extending through said end plate from said first chamber to an outer surface of said first scroll member, said modulation assembly including a valve assembly in communication with said third passage and selectively providing communication between said third passage and the suction pressure region to displace said piston between the first and second positions.

17. The compressor of claim 16, wherein said discharge passage is in communication with the suction pressure region when said piston is in the second position.

18. The compressor of claim 14, further comprising a floating seal engaged with said first scroll member and said housing to isolate the suction pressure region from said discharge passage, said floating seal and said housing defining a second chamber in communication with a second of said pockets to bias said first scroll member axially toward said second scroll member.

19. The compressor of claim 18, wherein said biasing member is located within said second chamber and is engaged with said floating seal and said first scroll member.

20. The compressor of claim 19, wherein said biasing member urges said floating seal into engagement with the housing to isolate the suction pressure region from said discharge passage when said first aperture is in communication with the suction pressure region.

* * * * *

UNITED STATES PATENT AND TRADEMARK OFFICE

CERTIFICATE OF CORRECTION

PATENT NO. : 7,976,295 B2
APPLICATION NO. : 12/474633
DATED : July 12, 2011
INVENTOR(S) : Robert C. Stover et al.

It is certified that error appears in the above-identified patent and that said Letters Patent is hereby corrected as shown below:

| | |
|---|---|
| Column 2, Line 3 | After “include”, delete “of”. |
| Column 2, Line 13 | After “piston”, insert --is--. |
| Column 2, Line 17 | “a axial” should be --an axial--. |
| Column 2, Line 28 | “discharge a” should be --a discharge--. |
| Column 2, Line 37 | “maybe” should be --may be--. |
| Column 2, Line 41 | “maybe” should be --may be--. |
| Column 2, Line 44 | “maybe” should be --may be--. |
| Column 2, Line 62 | “extended” should be --extend--. |
| Column 3, Line 13 | After “include”, delete “of”. |
| Column 8, Line 9 | After “piston”, insert --is--. |

Signed and Sealed this
Eighteenth Day of October, 2011

David J. Kappos

David J. Kappos
*Director of the United States Patent and Trademark Office*